United States Patent [19]

McKlveen

[11] 4,173,860

[45] Nov. 13, 1979

[54] TEXTURED SYNTHETIC FIBER YARN AND PROCESS FOR MAKING SAME

[76] Inventor: John R. McKlveen, 204 Norwood Dr., Colonial Heights, Va. 23834

[21] Appl. No.: 747,964

[22] Filed: Dec. 6, 1976

Related U.S. Application Data

[63] Continuation of Ser. No. 554,642, Mar. 3, 1975, abandoned.

[51] Int. Cl.[2] ..... D02G 1/02

[52] U.S. Cl. ..... 57/247; 57/288

[58] Field of Search ..... 57/157 TS, 157 S

[56] References Cited

U.S. PATENT DOCUMENTS

| | | | |
|---|---|---|---|
| 3,683,611 | 8/1972 | Buzano | 57/157 TS |
| 3,695,026 | 10/1972 | Taylor | 57/157 TS X |
| 3,775,961 | 12/1973 | Womer | 57/157 S |
| 3,796,036 | 3/1974 | Parker | 57/157 TS |

FOREIGN PATENT DOCUMENTS

| | | | |
|---|---|---|---|
| 815202 | 6/1959 | United Kingdom | 57/157 TS |

*Primary Examiner*—Charles Gorenstein

[57] ABSTRACT

A new method has been invented for introducing texture, crimp, or set twist into synthetic polymer yarns which eliminates the need to heat the yarns prior to the texturing step. It has been found that the heat generated in the drawing step of synthetic yarn manufacturing processes is sufficient to cause a twisted undrawn yarn to retain the twist permanently after being drawn. The mild heat treatment experienced by the fibers is highly uniform and produces textured yarns of exceptional uniformity, especially with respect to dyeability, as compared with textured yarns produced by known art processes.

6 Claims, No Drawings

TEXTURED SYNTHETIC FIBER YARN AND PROCESS FOR MAKING SAME

This is a continuation of application Ser. No. 554,642, filed Mar. 3, 1975, abandoned.

"It is known in the art relating to drawn or molecularly oriented thermoplastic continuous filament fibers and yarns to introduce essentially uniform heat set deformations into the fibers by processes in which the fibers are deformed by crimping, e.g. in a stuffer box, by twisting, e.g. by use of a false twist spindle, by curling, e.g. on a knife edge, or by other means while maintaining the fibers at a temperature above their softening point and cooling the fibers to a temperature below their softening point to set the deformations, thus providing commercially desirable properties of bulk, stretch, springiness, texture, or appearance in the products made from the fibers. The processes normally comprise the steps of heating the fibers to soften them, treating to induce the desired type of deformation, and cooling them in the deformed state prior to taking them up on packages for storage or shipment. Alternatively, the fibers may be softened by heat while being held in the deformed state.

Also, it has been known and practiced in the fiber industry to combine two or more manufacturing operations on the same machine for various reasons, e.g. to save labor, to reduce equipment investment, to save space. Thus, it has been known and practiced to melt spin synthetic fibers and draw them in a continuous manner on a combined spinning and drawing machine, as opposed to spinning the fibers, taking them up on a package, transferring the package to a draw frame, and drawing in a discrete operation. Other examples are drawing combined with twisting on draw twisters and drawing combined with texturing on draw texturizing machines.

However, regardless of the sequence of operations or steps, when the product of the process is a twist textured yarn the yarn has always been heated as a step in the process, e.g. by passing the yarn over a shoe heater or through a steam chest, and the deformation of the heated yarn has always been followed by a period of cooling to set the twist texture in the yarn. The inherent difficulties encountered in controlling the temperature of the heaters and thus the temperature reached by the yarn introduces a greater degree of nonuniformity into the yarn than existed prior to the heat treatment."

I have invented a process for producing a textured yarn or fiber from continuous filament fibers of any thermoplastic fiber-forming polymer wherein the manufacture of the fibers or yarn includes a drawing step or orientation step. This process is an improvement over known art processes in which the fibers are softened by being heated in some manner such as by being passed over a shoe heater, are then twisted, e.g. by a false twist spindle, and are cooled while in the twisted condition. The invention consists in the discovery that it is possible to introduce permanent texture or twist into the fiber without having to first heat it if the fiber fed to the process is in the undrawn state. My new process eliminate heating of the yarn prior to the texturing step. In fact, no heaters or other source of heat are employed.

"Accordingly, it is an object of my invention to make a twist textured yarn by a process that does not use any heater. A further object is to provide a high speed process for producing twist textured yarns. A further object is to provide a process for producing twist textured yarns having extremely high dye uniformity. Another object is to provise a process requiring lower capital investment costs and lower operating costs than any of the known art processes."

In my process, I twist undrawn fibers such as nylon 6, nylon 6-6, or polyester, and then make use of the heat generated in the fibers during the drawing process to soften the fibers and allow them to assume a permanently twisted form. Any of the known methods of twisting yarn and fiber including those referred to as false twisting may be employed to twist the undrawn yarn, and any of the known systems for drawing thermoplastic continuous filament yarns may be used.

As soon as the fiber has been drawn, I find that the twist is permanently fixed and thermally stable. At this point in the processing, I may untwist the yarn to develop the texture, and I may heat and cool the yarn in known ways to modify the properties of the textured product. The yarn may then be taken up on packages or cut into staple fiber, or treated in any of the other known ways of handling textured yarns. The several products of this process are suitable for the manufacture of knit or woven textiles, carpets, hosiery, etc. and are superior to the similar products produced by known processes because they have higher quality and lower manufacturing cost.

As an example of my process, as undrawn nylon 6 multifilament yarn of about 250 undrawn denier was twisted at room temperature to 280 turns per inch and was then drawn without the use of external heat to a drawn denier of about 70. The resulting, product had 78 to 80 turns per inch of twist, was springy and, had excellent dyeing uniformity.

In a second example, an undrawn nylon 6 multifilament yarn of about 4000 undrawn denier was twisted at room temperature to 130 turns per inch and was then drawn without the use of external heat to a drawn denier of about 1200. The resulting yarn had 40 to 44 turns per inch of twist, was springy and, had excellent dyeing uniformity.

In another example, two undrawn polyester multifilament yarns each of about 180 undrawn denier were twisted together to produce a high degree of twist. While twisted together, the yarns were passed over a very small heater, several orders of magnitude smaller than those used in commercial yarn texturing processes, to raise the yarn temperature above the transition temperature of the polyester and initiate the drawing process, and the yarns were drawn without the addition of heat from any external source to a denier of about 40 for each yarn. The two yarns were then separated. Each yarn was textured, was uniform in appearance, and was springy. No dye tests were performed.

My new process represents a large improvement over any known art because it eliminates the need for heaters in the texturing step and it eliminates the need for a separate drawing step. During the drawing step, the fibers absorb energy and convert it to heat. This heat effect has been known and is a measurable amount. While known processes referred to in the trade as draw-texture processes have succeeded in reducing the equipment and labor requirements by making it possible to perform drawing and texturing on the same machine, such equipment incorporates the same expensive heaters, temperature controllers, and alarms found in processes which draw and texture the yarns in two separate and unconnected steps.

In addition to the economic disadvantage inherent in processes which requires a large investment in heaters and related controls is known art texturing processes, there is an additional disadvantage in these processes in the nonuniform quality of the products. Even the best heater systems that are encomically feasible have controllers that allow a 3° to 5° F. error detection span, and inherent heater drift may cause the heater temperatures to cycle as much as 20° F. The resulting product will take up dyes unevenly because the sections of yarn exposed to the higher temperatures will take up the dye at a different rate than those sections that were exposed to the lower temperatures. Products made from such yarns, if dyed, will have dye streaks which either make the product commercially unacceptable or reduce its value.

While the production of a high quality product is considered to be the most important feature of my process, a second feature of great value is the saving in capital made possible by eliminating the need for heaters, heater controls, and alarms, and by being able to design machines that will not require the high ceiling or two-story buildings required by known texturing processes. Further, in my process, savings in labor result from simpler string-up and from elimination of repair and maintenance costs for the heater systems. Other savings result in my process from the elimination of the need for the large amounts of power required to operate the heaters in known processes.

My process is also more versatile than known art processes, permitting economical processing of high denier yarns whose production is presently uneconomical because of the slow machine speeds required to bring the yarns up to temperature and because of the poor dyeing characteristics of the product which result from the nonuniform heat penetration experienced by the large diameter yarn bundle. The use of my process permits texturing machine speeds to equal drawing machine speeds, since machines employing my process do not have the limitation of known art draw-texturing machines which can only run as fast as heat can be transferred with acceptable uniformity from the heaters to the yarn.

I claim:

1. A process for making a textured continuous filament synthetic yarn consisting essentially of the steps of twisting two or more drawable fibers, drawing the fibers while in the twisted state thereby permanently fixing the twist in the fibers, and untwisting the fibers.

2. The process of claim 1 when the yarn is twisted by means of a false twist spindle.

3. Yarns and textile products containing such yarns made by the process of claim 1.

4. The process of claim 1 when the drawable fibers are from the group nylon 6 and nylon 6,6.

5. The process of claim 2 when the drawable fibers are from the group nylon 6 and nylon 6,6.

6. The process of claim 1 wherein the yarn is thermoplastic.

* * * * *